US006538617B2

(12) United States Patent
Rochelle

(10) Patent No.: US 6,538,617 B2
(45) Date of Patent: Mar. 25, 2003

(54) TWO-AXIS, SINGLE OUTPUT MAGNETIC FIELD SENSING ANTENNA

(75) Inventor: James M. Rochelle, Knoxville, TN (US)

(73) Assignee: Concorde Microsystems, Inc., Knoxville, TN (US)

( * ) Notice: Subject to any disclaimer, the term of this patent is extended or adjusted under 35 U.S.C. 154(b) by 0 days.

(21) Appl. No.: 10/038,195

(22) Filed: Jan. 3, 2002

(65) Prior Publication Data

US 2002/0093331 A1 Jul. 18, 2002

Related U.S. Application Data

(63) Continuation of application No. 09/499,948, filed on Feb. 8, 2000, now abandoned.

(51) Int. Cl.[7] ..... H01Q 7/04; H01Q 7/06
(52) U.S. Cl. ..... 343/788; 343/842
(58) Field of Search ..... 343/741, 742, 343/788, 842

(56) References Cited

U.S. PATENT DOCUMENTS

| | | | |
|---|---|---|---|
| 2,432,858 A | | 12/1947 | Brown |
| RE23,397 E | | 8/1951 | Felch, Jr. et al. |
| 2,623,924 A | | 12/1952 | Cartier et al. |
| 2,927,734 A | | 3/1960 | Vance |
| 3,078,042 A | | 2/1963 | Grado |
| 3,103,663 A | | 9/1963 | Parker |
| 3,109,588 A | | 11/1963 | Polhemus et al. |
| 3,121,228 A | | 2/1964 | Kalmus |
| 3,133,283 A | | 5/1964 | Ghose |
| 3,187,169 A | | 6/1965 | Tramell, Jr. et al. |
| 3,354,459 A | | 11/1967 | Schwartz et al. |
| 3,430,243 A | | 2/1969 | Evans |
| 3,432,751 A | | 3/1969 | Godby et al. |
| 3,526,886 A | | 9/1970 | Lubich |
| 3,529,682 A | | 9/1970 | Coyne et al. |
| 3,560,977 A | | 2/1971 | Cayzac |
| 3,589,454 A | | 6/1971 | Coyne |
| 3,594,809 A | | 7/1971 | DeCola et al. |
| 3,614,950 A | | 10/1971 | Rabey |
| 3,644,825 A | | 2/1972 | Davis, Jr. et al. |
| 3,656,161 A | | 4/1972 | MacPherson |
| 4,879,570 A | * | 11/1989 | Takizawa et al. ..... 343/788 |

* cited by examiner

*Primary Examiner*—Michael C. Wimer
(74) *Attorney, Agent, or Firm*—Pitts & Brittian, P.C.

(57) ABSTRACT

A passive, non-multiplexed, two-axis antenna for sensing time-varying magnetic fields of a particular carrier frequency at a second point in space as produced by a electromagnetic field generator located at a first point in space. The antenna has a particular sensitive plane and produces a single output signal having amplitude proportionally related to the magnitude of the incident magnetic field's vector projection onto the antenna's sensitive plane. If the phase of the magnetic field is known, then the antenna's signal is processed to obtain the incident magnetic field's vector components. The antenna enables the realization of two- or three-axis magnetic field receivers with reduced signal processing complexity, cost and power requirements.

28 Claims, 11 Drawing Sheets

TWO-AXIS, SINGLE OUTPUT MAGNETIC FIELD SENSING ANTENNA

CROSS-REFERENCE TO RELATED APPLICATIONS

This is a continuation of U.S. Application No. 09/499,948, filed Feb. 8, 2000, now abandoned.

STATEMENT REGARDING FEDERALLY SPONSORED RESEARCH OR DEVELOPMENT

Not Applicable.

BACKGROUND OF THE INVENTION

1. Field of Invention

The present invention relates to an apparatus and a method for sensing quasi-static (near-field) time-varying magnetic fields radiated by magnetic field generators, such as those employed in short range communication systems, distance measuring systems, and systems for detecting, monitoring, tracking, or determining the location, direction, position, or orientation of a remote object, either animate or inanimate, in relation to reference point, such as the transmitter or a wireless perimeter. More particularly, the invention relates to a non-multiplexed, single-output magnetic field antenna which requires only one signal amplifier for signal processing and which provides an omnidirectional magnetic field response when rotated about a principal axis.

2. Description of the Related Art

Systems employing a generator of a time-varying electromagnetic field of a particular carrier frequency positioned at a first location and a magnetic field receiver positioned at a second location remote from the first location but within the near-field radiation zone are known in the prior art. Such systems are used for determining the distance between the generator and receiver locations and for determining the coordinates of the receiver's location with respect to the transmitter's frame of reference. Examples of such applications include location and tracking of a lead vehicle with respect to a following vehicle, location of child relative a parent's location, location of a diver relative to a home-base boat, location of an animate or inanimate object relative to a kiosk, mapping or digitization of two- or three-dimensional surfaces, monitoring of a probe inserted into the body, monitoring position of personnel, equipment, and tools in underground and underwater applications, and monitoring body movements for biomechanical control systems or for nonverbal communications means. Such systems are additionally used for determining position and orientation of the receiver's frame of reference with respect to the generator's frame of reference. Examples of such applications include the monitoring of position and orientation of actors on a stage or production set, monitoring position and orientation of an aircraft relative to a landing zone, monitoring position and orientation of military personnel and equipment relative to a command post, monitoring position and orientation of one object relative to a mating object, launching an aircraft ordinance along a pilot's line of sight, and orientation sensing for generation of virtual reality computer graphics. Another application for such systems is a short range communication link where the radiated signal is detectable at short ranges, but undetectable at longer ranges to enhance security and reduce interference. Examples include such applications as kiosk installations which interrogate a customer's "smart card" for identification purposes. Finally, such systems are used to establish wireless boundaries relative to the generator's frame of reference. Examples of such systems include systems for training a dog or other animal to stay either inside or outside a wireless boundary and for monitoring the movement of institutionalized persons to determine when they attempt to stray beyond the prescribed wireless boundary.

All of these prior art systems typically employ a one-, two-, or three-axis magnetic field generator radiating at a particular carrier frequency, typically in the extremely low frequency (ELF) or very low frequency (VLF) ranges. The receiver is typically equipped with a multiple axis array of mutually-orthogonal individual one-axis loop antennas consisting of a plurality of conductor turns wound on a ferrite core to enhance coupling with the magnetic field for increased receiver sensitivity. Each individual one-axis loop antenna is typically connected to a corresponding signal amplification and processing electronics channel in the receiver such that a two-axis receiver typically requires a two channel receiver and a three-axis receiver typically requires a three channel receiver. This multiplicity of receiver channels is a distinct disadvantage in those applications where miniaturization of the receiver size and power requirements are important considerations. There remains a need for an improved magnetic field receiving antenna providing multi-axis sensing, but not requiring separate signal amplification and processing channels for each axis of interest.

Therefore, it is an object of the present invention to provide an antenna for sensing a time-varying magnetic field of a particular carrier frequency radiated by a magnetic field generator unit, or a two-axis, single output magnetic field sensing antenna.

It is another object of the present invention to provide a two-axis, single output magnetic field sensing antenna wherein the amplitude of the sensed magnetic field is invariant as the antenna is rotated about an axis lying orthogonal to the antenna's sensitive plane and passing though its center.

It is a further object of the present invention to provide a two-axis, single output magnetic field sensing antenna wherein only one signal must be amplified and otherwise processed to obtain information about the receiver location within a particular plane.

Yet another object of the present invention is to provide a two-axis, single output magnetic field sensing antenna wherein no signal combining is necessary to compute the projected magnetic field amplitude.

A still further object of the present invention is to provide a two-axis, single output magnetic field sensing antenna which can be combined with a standard one-axis loop antenna to provide information about the magnitude of the incident time-varying magnetic field in three dimensions and the orientation of the antenna's frame of reference relative to vector direction of the incident magnetic field.

An additional object of the present invention is to provide a two-axis, single output magnetic field sensing antenna which can be used to obtain the magnetic field's orthogonal components lying within the sensitive plane and lying along each axis of a particular antenna frame of reference.

It is also an object of the present invention is to provide a two-axis, single output magnetic field sensing antenna which accurately senses the magnetic field.

One more object of the present invention is to provide a two-axis, single output magnetic field sensing antenna which can be used in low power applications to provide accurate information about the location of a receiver relative to a transmitter.

Another object of the present invention is to provide a two-axis, single output magnetic field sensing antenna which can be used in applications where consistent and repeatable distance measurements between a transmitter and receiver are required.

BRIEF SUMMARY OF THE INVENTION

The present invention is directed to a receiving antenna at one location for sensing and detecting the time-varying magnetic field of a particular carrier frequency radiated by an electromagnetic field generator at another location. Compared to the prior art one-axis loop antenna, the present invention provides two axes of sensitivity with no increase in antenna signal amplification or processing requirements. When compared to the prior art two-axis antenna comprised of two mutually-orthogonal one-axis loop antennas, the present invention provides an equivalent two-axis sensitivity but with reduced signal amplification and processing requirements.

The antenna is totally passive and provides a single electrical output signal having an amplitude which is proportionally related to the magnitude of the incident magnetic field and invariant as the antenna is rotated about an axis lying orthogonal to the antenna's sensitive plane and passing through its center. The amplitude of the antenna's single output signal is a direct measure of the amplitude of the incident magnetic field vector as projected onto the antenna's sensitive plane. Therefore, the amplitude of the antenna's single output signal is also a direct measure of the square root of the total combined power contained in the two orthogonal magnetic field components lying within the antenna's sensitive plane. This method for sensing magnetic field amplitude in a particular plane is an improvement over the standard method of using two separate, mutually-orthogonal one-axis loop antennas in that only one signal must be amplified and otherwise processed, rather than two. Additionally, no signal combining is necessary to compute either the projected magnetic field amplitude because the information is carried in the amplitude of the single output signal or the total magnetic field power contained within the two components of the magnetic field which lie within the antenna's sensitive plane. Where three-dimensional information is needed, the two-axis, single output magnetic field sensing output antenna of the present invention is combined with a one-axis loop antenna positioned orthogonal to the invention's sensitive plane such that two output signals of the combination carries the same information about the magnitude of the incident time-varying magnetic field as a conventional three-axis antenna consisting of three separate and mutually orthogonal one-axis antennas. The combined antenna using the present invention is preferred over a standard three-axis antenna because only two signals must be amplified and otherwise processed, rather than three, to compute the total power in the incident magnetic field as commonly required in distance or proximity determining applications.

Furthermore, the phase difference between the phase of the time-varying incident magnetic field and the phase of the invention's single output signal provides the information needed to obtain the magnetic field's orthogonal components lying within the sensitive plane and lying along each axis of a particular antenna frame of reference. This method of sensing the magnetic field components lying in one of the planes of the antenna's frame of reference is also an improvement over the standard method of using two separate, mutually-orthogonal one-axis loop antennas in that only one signal must be amplified and otherwise processed rather than two. The two-axis, single output antenna of the present invention is combined with a one-axis loop antenna positioned orthogonal to the invention's sensitive plane such that the two output signals which are generated are processed to determine the magnetic field's three spatial components with respect to the antenna's frame of reference as is commonly required in systems that determine the orientation of the receiver frame of reference with respect to the generator frame of reference.

In the preferred embodiment, the antenna is constructed of identical inductors and standard value capacitors for ease of manufacture. The antenna is configured to have a particular bandwidth or quality factor, Q, as may be dictated by additional constraints. The antenna can be provided with a low-Q characteristic to avoid the need for adjustable components needed for trimming or fine-tuning during manufacture. Alternately, the antenna can be provided with a higher-Q characteristic for better rejection of out-of-band signals. In the preferred embodiment, the improved antenna is shielded for the purpose of attenuating interfering time-varying electric fields such as those radiating from the magnetic field generator unit. This shielding provides for improved magnetic field sensing accuracy and is conveniently provided by coating the antenna with a partially conducting coating of a particular resistivity such that the antenna's electric field sensitivity is significantly attenuated with minimal attenuation of its magnetic field sensitivity.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A passive, two-axis, single output antenna for sensing a time-varying magnetic field is shown generally at 10 in the Figures. It is helpful to consider the corresponding prior art antennas in detail prior to describing the present invention.

Figure 1:
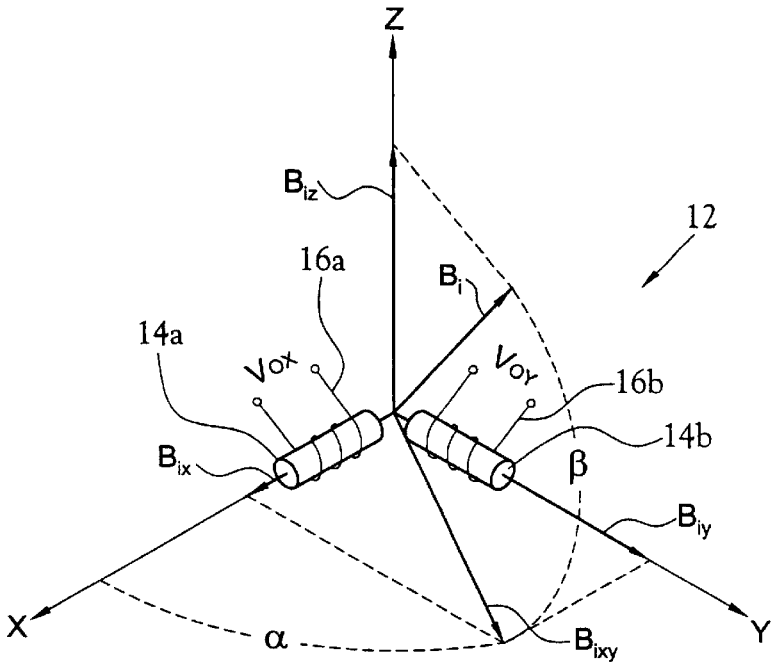
Fig.1 (PRIOR ART)
FIG. 1 is a diagram of an arbitrary magnetic field vector incident on the prior art two-axis, two-signal magnetic field sensor having two separate output signals, one for each axis.

For reference, a typical prior art two-axis antenna 12 consisting of two separate and mutually orthogonal one-axis loop antennas 14 is shown in FIG. 1. In the prior art, a first loop antenna 14*a* is aligned with the X-axis and produces electrical output signal $V_{ox}$ from a first output 16*a* and a second loop antenna 14*b* is aligned with the Y-axis and producing second electrical output signal $V_{oy}$ from a second output 16*b*. Those skilled in the art will recognize that the signal of the X-axis loop antenna 14*a* only provides information about $B_{ix}$, the projection of the magnetic field vector onto its sensitive axis, and the signal of the Y-axis loop antenna 14*b* only provides information about $B_{iy}$, the projection of the magnetic field vector onto its sensitive axis. Thus, both $V_{ox}$ and $V_{oy}$ must be separately amplified, processed, and computationally combined to provide a measure of the total power contained in two of the magnetic field's three principal rectangular components.

Figure 2:
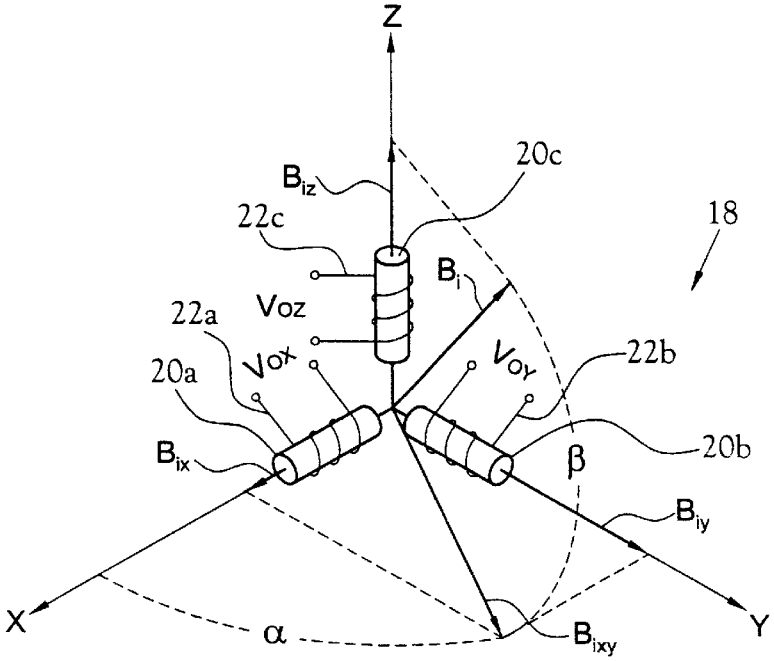
Fig.2 (PRIOR ART)
FIG. 2 is a diagram of an arbitrary magnetic field vector incident on the prior art three-axis magnetic field sensor having three separate output signals, one for each axis.

Referring now to FIG. 2, a typical prior art three-axis antenna 18 consisting of three separate and mutually orthogonal one-axis loop antennas 20*a*, 20*b*, 20*c* is shown. In the same manner as above described, each of the three electrical output signals, provides information about the magnetic field's projection onto the sensitive axis of the respective loop antenna 20. Thus, a measure of the total power in the magnetic field, as is commonly used by those skilled in the art to determine distance from the magnetic field generator to the sensing antenna, can only be formed by separate amplification, processing, and computational combination of all three electrical signals.

Figure 3:
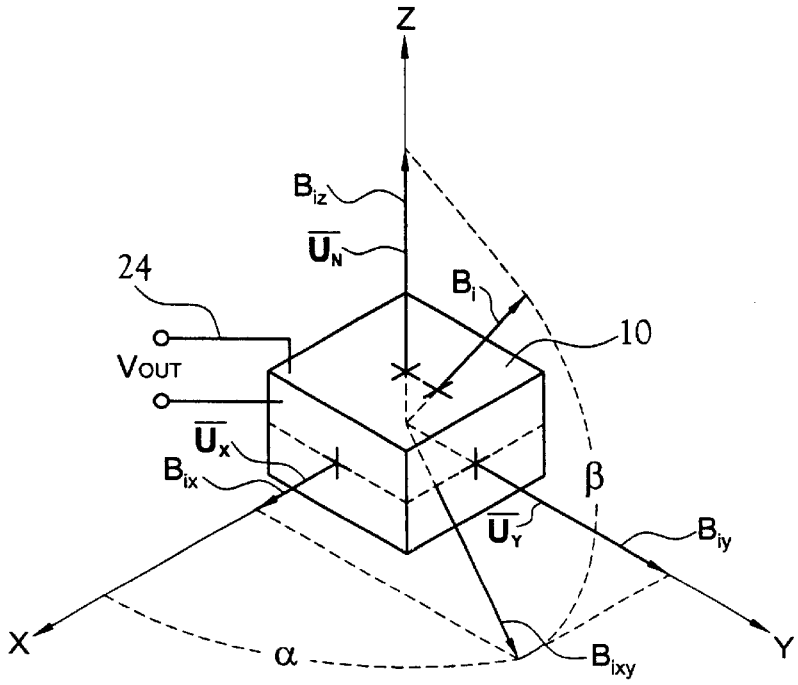
FIG. 3 is a diagram illustrating an arbitrary magnetic field vector incident on the two-axis, single output magnetic field sensing antenna having one electrical output signal.

FIG. 3 illustrates the two-axis, single output antenna 10 for sensing a time-varying magnetic field of a particular carrier frequency. The antenna's sensitive plane is arbitrarily assumed to be the X-Y plane of the antenna's frame of reference and the antenna's normal axis is aligned with the Z-axis. The two-axis, single output antenna 10 is effective to sense a time-varying vector magnetic field of an appropriate carrier frequency having arbitrary magnitude $B_i$ with a vector direction making arbitrary angles $\beta$ and $\alpha$ with the antenna's frame of reference. For illustration, the vector decomposition of the magnetic field into its three principal rectangular vector components, $B_{ix}$, $B_{iy}$, and $B_{iz}$, are shown in FIG. 3. In response to the magnetic field, the two-axis, single output antenna 10 has a single electrical output 24 which produces a signal which is a direct proportional measure of the magnitude of $B_{ixy}$, the projection of the magnetic field vector onto the antenna's sensitive plane, the X-Y plane. Thus, from geometrical considerations, the power in the $V_{out}$ signal is seen to be a direct proportional measure of the total power contained in two of the magnetic field's three principal rectangular vector components, $B_{ix}$ and $B_{iy}$. The present invention also permits processing of the $V_{out}$ signal to yield proportional measures of both $B_{ix}$ and $B_{iy}$ individually, provided that the time phase of the incident field is also made available by means known to those skilled in the art.

Figure 4:
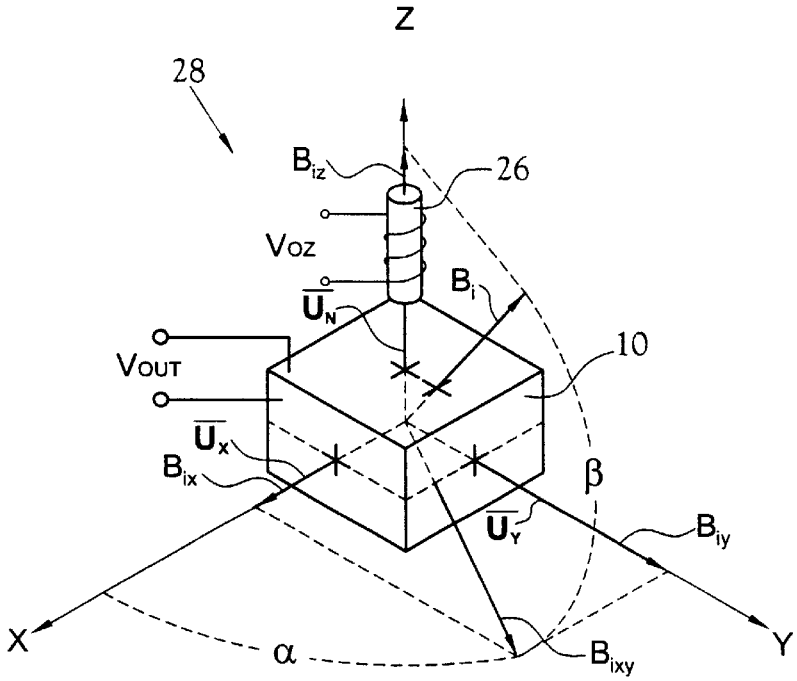
FIG. 4 is a diagram of an arbitrary magnetic field vector incident on a three-axis magnetic field sensor obtained by combining the two-axis, single output magnetic field sensing antenna having one electrical output signal with a prior art one-axis sensor having a second electrical output signal.

By combining the two-axis, single output antenna 10 of the present invention with a prior art one-axis loop antenna 26 in the mutually orthogonal manner of FIG. 4, a three-axis antenna 28 having only two output signals is provided. Accordingly, only two signals need to be amplified, processed, and computationally combined to form a measure of the total power contained in the incident magnetic field.

Returning to FIG. 3, in the general case, assume the two-axis, single output antenna 10 is obtained with two passive elements, $E_1$ and $E_2$, for sensing time-varying magnetic fields transmitted at a certain carrier frequency, $f_o$. Also, assume that each of these elements has a principal geometrical, or sensitive, axis and that each produces a time-varying electrical response having an amplitude proportional to the amplitude of the projection of the incident magnetic field onto its sensing axis. Additionally, assume that the amplitude response of the two sensing elements behaves as described by $V_{o1}=K_sB_{p1}$ and $V_{o2}=K_sB_{p2}$, where $K_s$ is the transduction scaling factor and is assumed to be the same for both passive elements, $B_{p1}$ is the amplitude of the projection of $B_i$ onto the sensing axis of $E_1$, and $B_{p2}$ is the amplitude of the projection of $B_i$ onto the sensing axis of $E_2$. Further, assume that a single two-axis, single output antenna 10 is obtained by a superposition of elements $E_1$ and $E_2$ such that the sensitive axis of one is mutually orthogonal with the sensitive axis of the other. For illustrative purposes, the $E_1$ sensing axis is assumed to be aligned with the X-axis of the antenna frame of reference (indicated by the $u_x$ direction vector in FIG. 3) and the $E_2$ sensing axis aligned with the Y-axis of the antenna frame of reference (indicated by the $u_y$ direction vector in FIG. 3). The sensor frame of reference is further defined by a third axis (indicated by the $u_N$ direction vector in FIG. 3) lying along the Z-axis and mutually orthogonal with the X-axis and the Y-axis. Further, assume an incident sinusoidal time-varying magnetic field with amplitude $B_i$, frequency $f_o$, and a spatial direction vector making an angle $\beta$ with the X-Y plane. The projection of the incident magnetic field onto the X-Y plane is $B_{ixy}=B_i \sin \beta$ and is assumed to make a spatial angle $\alpha$ with the sensing axis of $E_1$ and a spatial angle of $90°-\alpha$ with the sensing axis of $E_2$. $B_{ixy}$ then produces the following projections onto the sensing axis of each element.

$$B_{p1}=B_{ix}=B_i \sin \beta \cos \alpha \quad (1)$$

$$B_{p2}=B_{iy}=B_i \sin \beta \sin \alpha \quad (2)$$

These projections in turn produce the following amplitude responses in each element $$V_{o1}=K_s B_i \sin \beta \cos \alpha \quad (3)$$

$$V_{o2}=K_s B_i \sin \beta \sin \alpha \quad (4)$$

This further assumes negligible cross-coupling between the elements, i.e., that each element responds only to the incident magnetic field $B_i$ and produces no net response due to the local parasitic magnetic field resulting from currents flowing in the other element. This desired result is obtained in the preferred embodiment of the invention.

Further, assume that the incident magnetic field vector $B_i$ has a time-varying intensity with amplitude $B_i$, time domain frequency $f_o$, and reference time domain phase of $\theta$. Now further assume that the elements $E_1$ and $E_2$ are passively tuned to have identical transduction scaling factors at the frequency $f_o$, and produce signals which are orthogonal to each other in the time domain. For complete generality, assume that the phase of each signal is offset by an additional phase shift of $\Phi$ relative to the reference phase. It is convenient to assume that $E_2$ is tuned to lag $E_1$ by 90° for illustrative purposes, but reversing the sequencing leads to the same conclusion. Also, assume that the two elements are series-connected to form a two-axis, single output antenna producing the single output signal designated as $V_{out}$ in FIG. 3. The time domain response of $V_{out}$ is then obtained from $$V_{o1}(t)=K_s B_i \sin \beta \cos \alpha \sin(\omega_o t+\theta+\phi) \quad (5)$$

$$V_{o2}(t)=K_s B_i \sin \beta \sin \alpha \sin(\omega_o t+\theta+\phi-\pi/2) \quad (6)$$

$$V_{out}(t)=K_s B_i \sin \beta \sin(\omega_o t+\phi) \quad (7)$$

where $\Phi=(\alpha+\theta+\phi)$, $\omega_0=2\pi f_o$, and use is made of the trigonometric identity $$\sin(i+k)=\sin i \cos k+\cos i \sin k \quad (8)$$

Equation 7 clearly shows that the amplitude response of the two-axis, single output antenna 10 does not depend on the orientation angle $\alpha$ and is a direct measure of $B_{ixy}$, the magnitude of the projection of $B_i$ onto the X-Y plane. This magnitude response is invariant as the antenna 10 is rotated about its Z-axis. The X-Y plane is the plane containing the sensing axes of both elements $E_1$ and $E_2$ and is hereinafter referred to as the antenna's sensitive plane. The Z-axis is normal to the sensitive plane and is hereinafter referred to as the antenna's "normal" axis and assigned a unit direction vector $u_N$. Thus, the antenna 10 produces an electrical response proportional to the magnitude of the projection of the incident magnetic field onto the antenna's sensitive plane and the response is invariant under rotation about its normal axis. If the transduction scaling factor, $K_s$, is known, then the two-axis magnetic field amplitude, $B_{ixy}$, is found directly from the magnitude of the sensor's output signal according to $$B_{ixy} = \frac{|V_{out}|}{K_s} \quad (9)$$

This is an improvement over the prior art two-axis, two-signal sensor of FIG. 1 which requires that two signals be amplified and otherwise processed and furthermore requires the following additional signal processing operations to extract a measurement of $B_{ixy}$.

$$B_{ixy} = \frac{1}{K_s}\sqrt{|V_{ox}|^2+|V_{oy}|^2} \quad (10)$$

Here it is assumed that the two prior art signals, $V_{ox}$ and $V_{oy}$, of FIG. 1 are like $V_{o1}$ and $V_{o2}$ of Equations 3 and 4.

According to Equation 9, the two-axis, single output antenna 10 makes possible the accurate and direct sensing of the incident magnetic field's amplitude independent of any change or variation in one of the antenna's possible degrees of orientation freedom, namely rotation about its normal axis through the angle $\alpha$. Those skilled in the art will recognize that determination of the incident magnetic field's amplitude, or power, in the near-field radiation zone provides for reliable and preferred means of determining the distance between a first animate or inanimate object corresponding to the location of the magnetic field generator and a second animate or inanimate object corresponding to the location of the receiving antenna. Those skilled in the art will recognize that the sensing of the incident magnetic field's amplitude, or power, in the near-field radiation zone provides useful means for proximity determining applications wherein the spacing between the generator and receiving antenna positions is determined to exceed a predetermined level when the incident magnetic field drops below a predetermined threshold level. Examples in the art include systems which sound an alarm when a child strays away from a parent by more than a safe distance and animal restraining systems which allow the training of an animal to remain within an area having a wireless boundary which is preestablished to be the locus of all points where the incident magnetic field intensity, or energy density, as interpreted by the receiver unit is equal to the fixed reference level. In many of these prior art applications, the receiving unit is attached to a movable animate or inanimate object and is therefore subject to considerable variation in orientation such that proper system operation is achieved only if the receiver's magnetic field sensing properties remain substantially unaffected by these changes in orientation. Equation 9 shows that the two-axis, single output antenna satisfies this basic orientation independence requirement regarding the sensing of the magnetic field projection $B_{ixy}$ defined in FIG. 3. Furthermore, the single output 24 of the present invention reduces the amplification and signal processing circuit requirements making the present invention well suited for use in the receiver unit for these types of applications. This is an additional important consideration in those applications where the receiver unit must be minimum size and weight for ease of portability and low in power usage to achieve long battery life operation.

Figure 5:
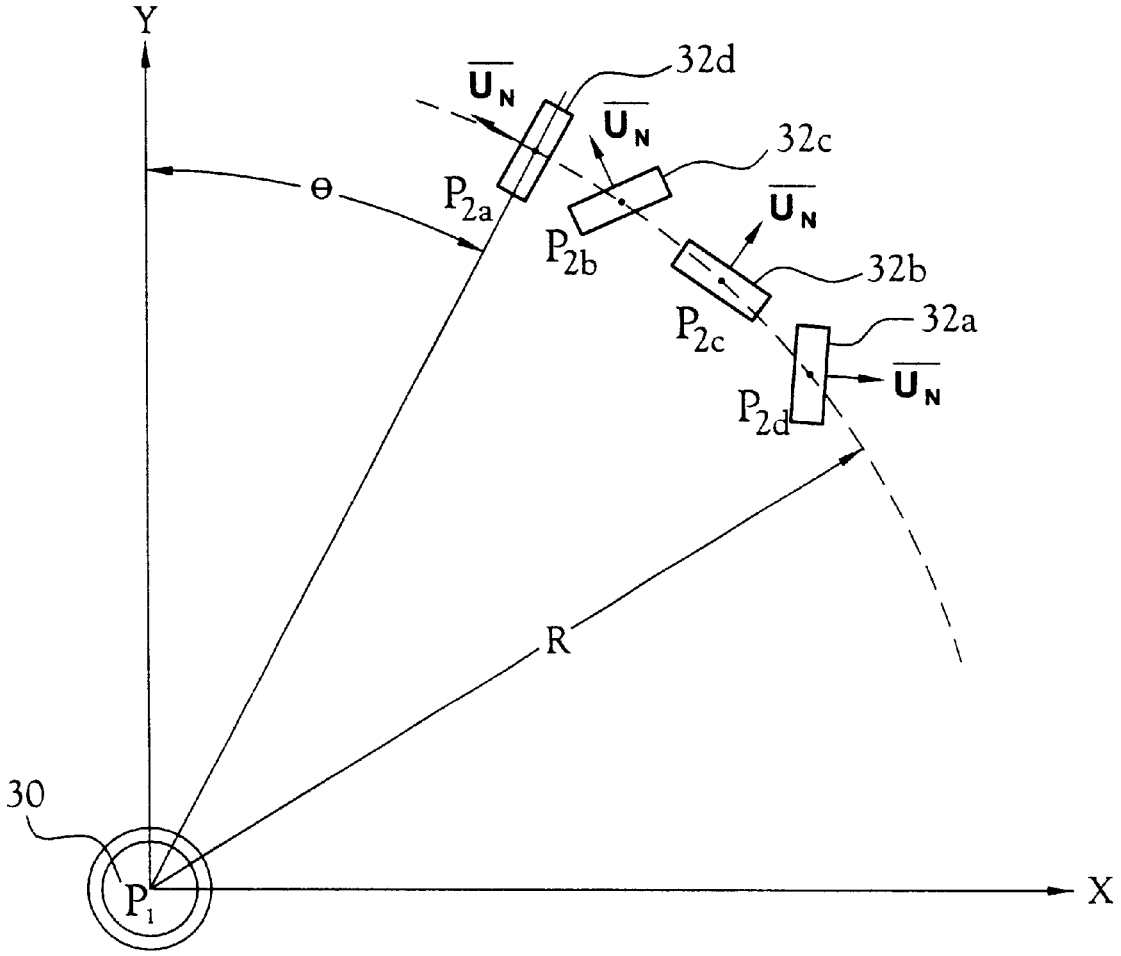
FIG. 5 is a drawing showing the two-axis, single output magnetic field sensing antenna deployed with different possible orientations in the X-Y plane to sense an incident magnetic field generated from a one-axis magnetic dipole source.
Figure 6:
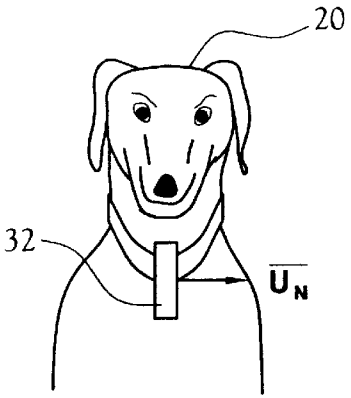
FIG. 6 is a drawing showing the two-axis, single output magnetic field sensing antenna mounted to sense a vertically directed magnetic field incident on an animal.

To further illustrate the features and applicability of the two-axis, single output antenna 10, consider an application where the magnetic field is produced by a generator 30 including single loop transmitting antenna (magnetic dipole)

as shown in FIG. 5. This arrangement is of considerable practical interest because of inherent transmitter simplicity and low cost. Further assume that movement and translation of a receiver unit 32 containing the two-axis, single output antenna 10 of the present invention is substantially confined to a single plane designated as the X-Y plane. Here the receiver 32 is assumed to be located at a point of reception called $P_2$ separated by a distance R from the single loop generator positioned at a point of generation $P_1$. The arbitrary location of $P_2$ relative to the generator 30 is further described by the angle θ which is the angle made between the Y-axis and a radial line passing through points $P_1$ and $P_2$. This special case is representative of a range of practical applications where the receiver 32 is attached to a mobile host that is moving around on substantially level terrain as indicated by the receiver units 32*a,* 32*b,* 32*c,* 32*d* shown in various orientations within the X-Y plane relative to the generator 30. The single magnetic dipole field is assumed to be generated by the single loop coil of the generator 30 that lies in the X-Y plane and has a principal axis in the Z-direction. From the theory of magnetic fields for current loops, the magnetic field vector for a free-space magnetic field incident at any point of reception in the X-Y plane has only a $u_z$ component, is independent of the angle θ, and exhibits an amplitude which decreases inversely with the cube of the separation distance R. These conditions apply when R is much smaller than the wavelength for electromagnetic wave propagation in space of the time-varying field (the so-called near-field, or quasi-static, condition) and when R is much greater than the physical size of the transmitting loop (negligible aperture effect). The antenna of the receiver unit 32 is further assumed to be maintained with its sensitive plane vertical (parallel with $u_z$) and its "normal axis" horizontal (parallel to X-Y plane and orthogonal to $u_z$). Those skilled in the art will recognize any number of ways to achieve this relationship, such as securing the receiver 32 to or suspending it from a person's belt, carried in or suspended from the pocket of a shirt or blouse, suspending the receiver 32 from the neck as a necklace, suspending from a shirt collar, attaching to a vertical surface (either inside or outside) of valuable items such as luggage, briefcase, laptop computer, purse, etc., attaching to a vertical surface of manufactured goods or their containers, hanging vertically within a vehicle such as from the rear view mirror, or attaching to or hanging from the collar of an animal 20 as illustrated in FIG. 6.

Figure 7B:
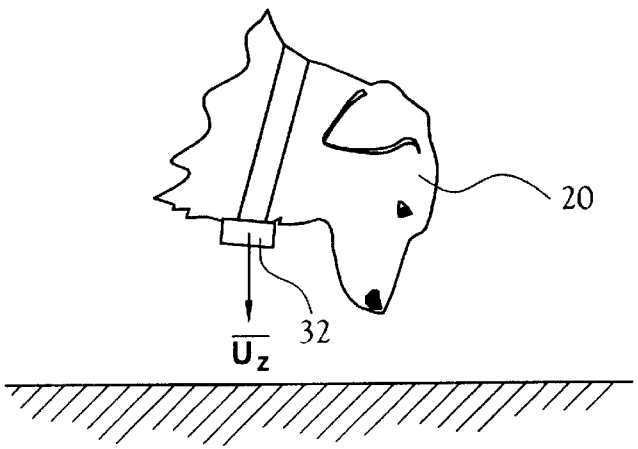
FIG. 7*b* is a drawing of the two-axis, single output magnetic field sensing antenna in a second orientation associated with up and down motion of the host animal's head and neck.
Figure 7A:
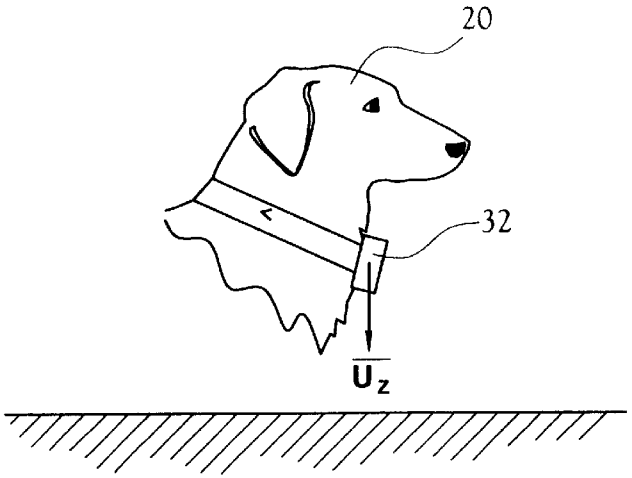
FIG. 7*a* is a drawing of the two-axis, single output magnetic field sensing antenna in a first orientation associated with a host animal in an alert position.
Figure 7C:
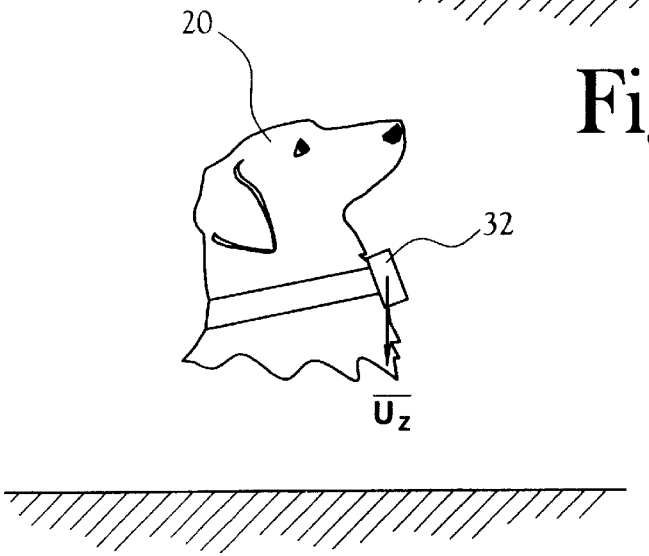
FIG. 7*c* is a drawing of the two-axis, single output magnetic field sensing antenna in a second orientation associated with up and down motion of the host animal's head and neck.

If, as applies in FIG. 5, the magnetic field has only a $u_z$ component and the receiving antenna's normal axis is maintained orthogonal to $u_z$, then the angle β in FIG. 3 and Equation 7 is always 90_ such that the response $V_{out}$ remains invariant as the antenna 10 is pointed in any direction in the X-Y plane. For example, because the field at a given R does not depend on θ, the accuracy for sensing the amplitude of the magnetic field needed for an accurate and reliable determination of R is the same for all of the receiver positions and orientations 32*a*, 32*b,* 32*c,* 32*d* illustrated in FIG. 5. This is also true for changes in orientation where the receiver antenna 10 essentially rotates about its "normal axis". In an illustration of this type of motion, collectively referred to as FIG. 7, the antenna's "normal axis" remains horizontal as the host animal 20 begins with the head in a level position, shown in FIGS. 6 and 7*a,* and moving from a "sniffing" position with the head and neck pointed downward, shown in FIG. 7*b,* to an erect position with the head and neck pointed almost vertically, shown in FIG. 7*c.* Here the distance measurement or detection accuracy remains unaffected by these extreme orientation changes provided the receiver's sensitive plane remains vertical and "normal axis" remains horizontal. Also, in this case, the incident magnetic field is only required to also be in a vertical plane and not necessarily in a true vertical direction.

Of course, magnetic field sensing errors together with corresponding distance determining errors will occur if the antenna's "normal axis" is tilted to become non-orthogonal with the magnetic field vector. This would occur, for example, if the animal 20 in FIG. 7 shook its head and neck with a side-to-side rotating motion. Some degree of receiver antenna tilting is typically allowable in all of these applications depending on the maximum allowable distance measurement error. Those skilled in the art will recognize that this error in magnetic field sensing and position determination due to antenna tilting into orientations such that the angle β in FIG. 3 and Equation 7 is not held constant at 90_ is eliminated by supplementing the present invention two-axis, single output antenna 10 with the additional prior art one-axis loop antenna 26 aligned mutually orthogonal as already presented in FIG. 4 and having the same transduction scaling factor. The two signals of the three axis antenna 28 of the present invention are amplified, processed, and combined to provide the same information about the amplitude of the incident magnetic field as the prior art three-axis, three-signal antenna 18 of FIG. 2. In particular, the magnetic field amplitude is obtained from $$B_i = \frac{1}{K_s}\sqrt{|V_{out}|^2 + |V_{oz}|^2} \tag{11}$$

which is independent of the angle β, such that the distance determining performance is made accurate for all possible receiving antenna orientations.

The foregoing example of a distance determination application is presented for illustration only and is not given to imply any limitation of the fields of application of the present invention. Those skilled in the art will recognize that the present invention two-axis, single output antenna 10 is applicable to any distance or proximity determining application which would otherwise use the prior art two-axis, two-signal receiving antenna 12. This extends to those distance and proximity determining applications where movement of the receiver 32 is not necessarily restricted to a particular plane and/or where the generator 30 is made to radiate a plurality of individually distinguishable, mutually-orthogonal magnetic fields. Also, those skilled in the art will recognize that a three-axis, two-signal antenna 28 realized from a combination of the present invention two-axis, single output antenna 10 together with a mutually orthogonal prior art one-axis antenna 26, as shown in FIG. 4, is applicable to any distance determining or proximity determining application which would otherwise use the prior art three-axis, three-signal receiving antenna 18. This also extends to those distance and proximity determining applications where movement of the receiver 32 is not necessarily restricted to a particular plane and/or where the generator 30 is made to radiate a plurality of individually distinguishable, mutually orthogonal magnetic fields.

Equation 7 also indicates that the phase angle Φ of the signal $V_{out}$ is a direct measure of the sum of the spatial angle α (defined in FIG. 3) together with the magnetic field reference time domain phase angle θ and the offset phase ϕ associated with the magnetic-field-to-voltage transduction process. This result has two useful applications. First, when the reference phase of the incident magnetic field and the offset phase shift are known, then the phase angle Φ of the signal produced by the two-axis, single output antenna 10 is compared to (θ+ϕ) to provide a direct measure of the spatial orientation of the antenna's frame of reference with respect to the direction of the incident magnetic field as represented by the angle α in FIG. 3. When used in conjunction with the measurement of $B_{ixy}$ (see Equation 9 above), this allows the extraction of the $B_{ix}$ and $B_{iy}$ field components according to $$B_{ix} = \frac{|V_{out}|}{K_s}\cos(\varphi - \theta - \phi) \tag{12}$$

$$B_{iy} = \frac{|V_{out}|}{K_s}\sin(\varphi - \theta - \phi) \tag{13}$$

Similarly, when used in combination with a mutually orthogonal one-axis antenna 26 as shown in FIG. 4, the two-axis, single output antenna 10 provides for the determination of all three rectangular components, $B_{ix}$, $B_{iy}$, and $B_{iz}$, of the vector magnetic field incident upon the resulting three-axis, two-signal antenna 28. Those skilled in the art will recognize that this arrangement is suitable for use in applications devoted to determination of the position of the receiver relative to the generator's frame of reference as well as determination of the orientation of the receiver's frame of reference with respect to the generator's frame of reference. This extends to those methods known to those skilled in the art whereby the prior art three-axis, three-signal conventional receiver antenna 18 is employed to sense the rectangular components of one or more mutually orthogonal and individually distinguishable magnetic field vectors radiated by a common generator for the purpose of providing input parameters to any of several algorithms known in the art for computing the position of the receiver 32 relative to the generator's frame of reference and for computing the orientation of the receiver's frame of reference relative to the generator's frame of reference.

Those skilled in the art will additionally recognize that the sensing of the near-field magnetic field properties are much preferred over sensing of the near-field electric field properties for distance, proximity, position, and orientation determining applications. The near-field electric field is generally not preferred in these applications because of susceptibility to extreme distortion introduced by the proximity to the ground and many other commonly encountered stationary and nonstationary objects such as buildings, vehicles or persons and animals. Consequently, the generator unit 30 used in these applications is normally intended to produce a quasi-static near-field radiation zone in which the magnetic field energy is dominant over the electric field energy. However, the generation of a time-varying magnetic field is always accompanied by the generation of some amount of time-varying electric field as well and all magnetic field receiving antennas, especially of the preferred loop antenna type tend to have some degree of electric field sensitivity in addition to the intended magnetic field sensitivity. Therefore, the accuracy of magnetic-field-based distance, proximity, position, and orientation determining systems is improved by suppressing the electric field component radiated by the generator unit 30 and/or by suppressing the electric field sensitivity of the receiving antenna relative to the magnetic field sensitivity. Suppressing the electric field sensitivity of the receiving antenna is particularly desirable because it rejects unwanted electric field signals from all other possible interference sources as well as from the magnetic field generator. In the preferred embodiment, the present invention two-axis, single output antenna 10 is provided with selective shielding to attenuate the electric field sensitivity with no significant reduction in the preferred magnetic field sensitivity. In accordance with the foregoing theoretical considerations, the present invention two-axis, single output magnetic field antenna is realized to have the following set of required aspects:

(a) two elements, $E_1$ and $E_2$, each of which has the same sensing axis amplitude response with said amplitude response being proportional to the projection of the magnetic field direction vector onto the sensing axis of each element;

(b) each element $E_1$ and $E_2$ being designed to produce electrical responses at a frequency $f_o$ and having equal transduction scaling factors which differ in time domain phase difference by 90°;

(c) elements $E_1$ and $E_2$ being mounted such that the sensing axes of one element is mutually orthogonal to the sensing element of the other element; and (d) elements $E_1$ and $E_2$ being mounted such that each element responds only to the incident magnetic field radiated from a generator location and produces comparatively negligible response due to the local parasitic magnetic field produced by current flowing in the other element.

While not required, it is desirable to consider another aspect for reducing the electric field sensitivity of the two-axis, single output antenna of the present invention:

(e) selective shielding to attenuate the antenna's electric field sensitivity without significantly degrading the desired magnetic field sensitivity.

Figure 8:
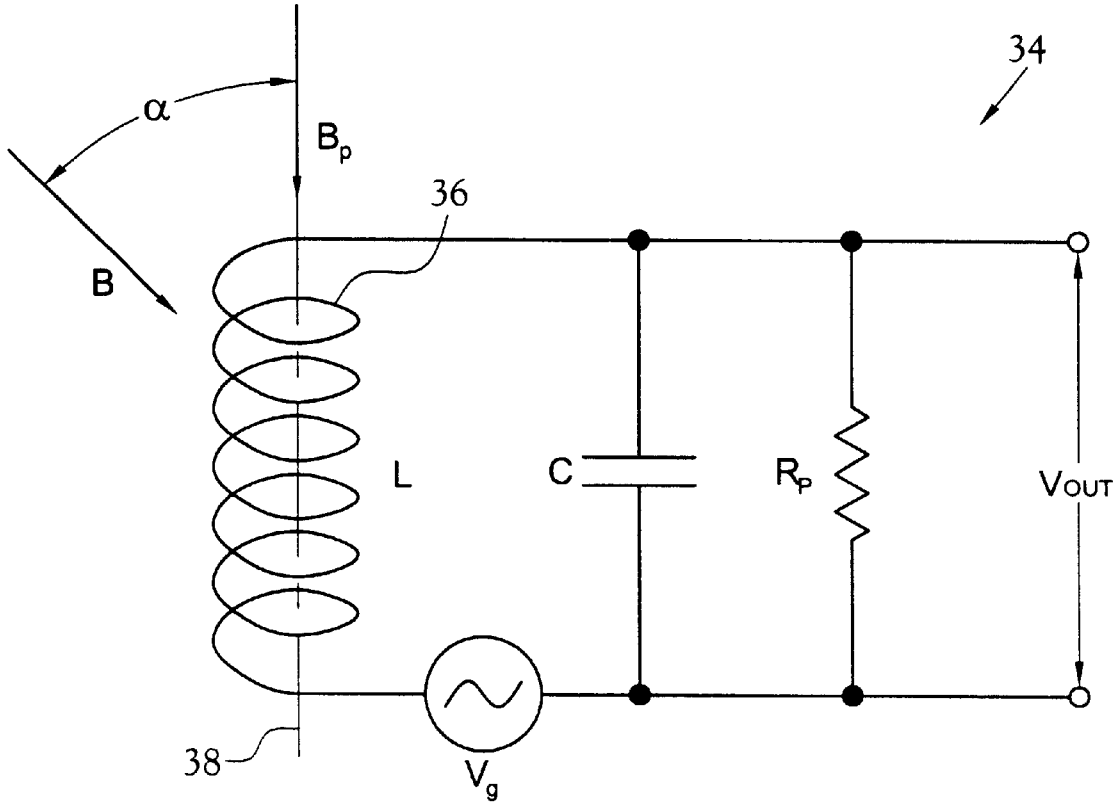
FIG. 8 is a schematic diagram of the equivalent lumped element electrical circuit model for each of the two elements contained in the two-axis, single output magnetic field sensing antenna.
Figure 9:
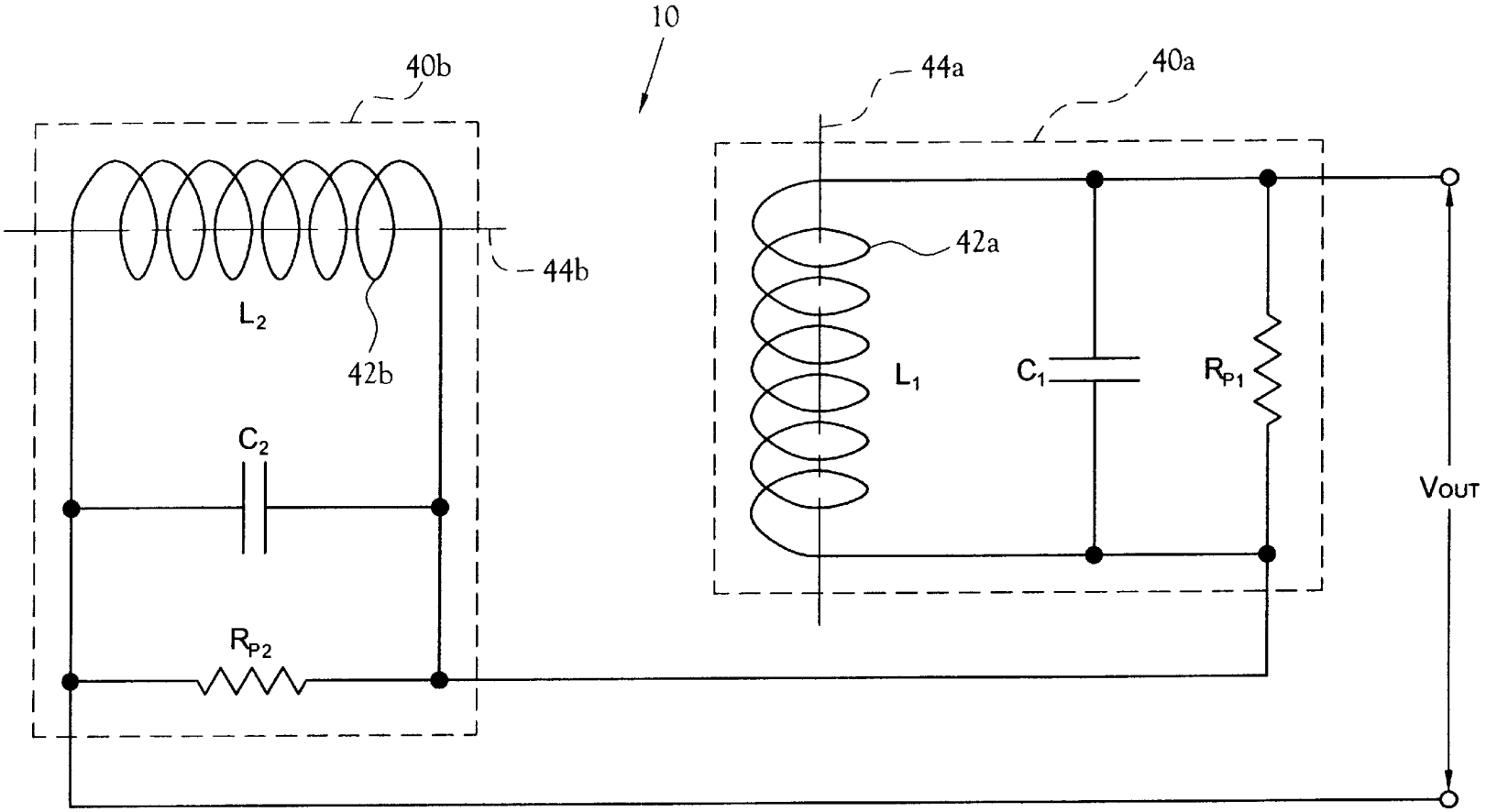
FIG. 9 is a detailed schematic diagram of the preferred embodiment of the two-axis, single output magnetic field sensor having a single electrical output signal.

Given these design requirements, the following is a detailed description of a preferred embodiment of a two-axis single output antenna 10 having a first element 40*a* ($E_1$) and a second element 40*b* ($E_2$), as illustrated in FIG. 9. Assume that each element consists of a simple parallel LCR resonant circuit having the lumped element equivalent circuit 34 of FIG. 8, where C represents the total parallel capacitance including the inductor's effective self-capacitance plus any added capacitance and $R_p$ represents the total equivalent parallel damping including a parallel representation of the effect of losses within the inductor plus any added loading. Further, assume that the inductor 36 is configured as a series electrical connection of one or more turns, or loops, with the principal axes of all turns being co-linear with each other to form the magnetic field sensing axis 38 of the inductor. From the laws of electromagnetic theory, the amplitude of the voltage generated in the coil by an incident time-varying magnetic field of frequency $f_o$ is proportional to the amplitude of the projection of the field onto the inductor's sensing axis, $B_p$, and is represented as $$V_g = K_g B \cos \alpha \tag{14}$$

Here $K_g$ is the effective transduction sensitivity at $f_o$ and depends primarily on the effective area circumscribed by the inductor's turns, the number of turns, the frequency of the magnetic field $f_o$, and the effective magnetic permeability of the core material on which the turns are wound. In the preferred embodiment, the magnetic core material is a ferrite having small loss tangent at the signal frequency $f_o$ which is bobbin shaped so that the turns are wound directly onto the ferrite core. Those skilled in the art will recognize that the two-axis, single output antenna 10 described herein can also be realized with other core configurations or even with simple air-core inductors.

The amplitude response of the output voltage of the LRC element 34 described by FIG. 8 relative to the input voltage induced by the projection of the magnetic field incident on the inductor 36 is $$\frac{V_{out}}{V_g} = \left[\left(\frac{f}{f_r Q_L}\right)^2 + \left(1 - \frac{f^2}{f_r^2}\right)\right]^{-\frac{1}{2}} \tag{15}$$

where $f_r$ is the element's basic resonant frequency given by $$f_r = [2\pi LC]^{-1/2} \tag{16}$$

and $Q_L$, is the element's loaded quality factor at resonance given by $$Q_L = 2\pi f_r R_p C \tag{17}$$

The electrical phase angle response of the output voltage of the element 34 relative to the input voltage induced by the projection of the magnetic field incident on the inductor 36 is $$\angle\left(\frac{V_{out}}{V_g}\right) = -\tan^{-1}\left[\frac{\frac{1}{f_r Q_L}}{1 - \frac{f^2}{f_r^2}}\right] \tag{18}$$

Referring again to FIG. 9, a study of these equations shows that a two-axis, single output antenna 10 having elements $E_1$ and $E_2$ and meeting requirements (a) through (c) is obtained by providing elements $E_1$ and $E_2$ identical sensing inductors 42*a*, 42*b* which are placed in a spatially orthogonal orientation with one element tuned to have an appropriate resonant frequency below $f_o$ and the other element tuned to have an appropriate resonant frequency above $f_o$. More specifically, the requirements of equal amplitude and electrically orthogonal phase response at $f_o$ requires that $$L_1 = L_2 = L = \frac{2}{(2\pi f_0)^2 (C_1 + C_2)} \tag{19}$$

and $$R_{p1} = R_{p2} = R_p = \frac{2}{2\pi f_0 (C_1 - C_2)} \tag{20}$$

These are sufficient conditions for meeting requirements (a) and (b) listed above. The required values of the two resonant frequencies depend on the choice of quality factor desired for each antenna element. A sharp resonance with high Q is best for rejecting out-of-band noise and signals, but may require trimming for proper tuning. Q factors in the range of 4 to 8 represent a good compromise between sensor bandwidth and trim-free manufacturability. The design requirements of Equations 19 and 20 are combined to give $$(C_1 - C_2) = \frac{(C_1 + C_2)}{Q_{avg}} \tag{21}$$

where $Q_{avg}$ is the average of $Q_1$ and Q2 evaluated at $f_o$

Figure 10:
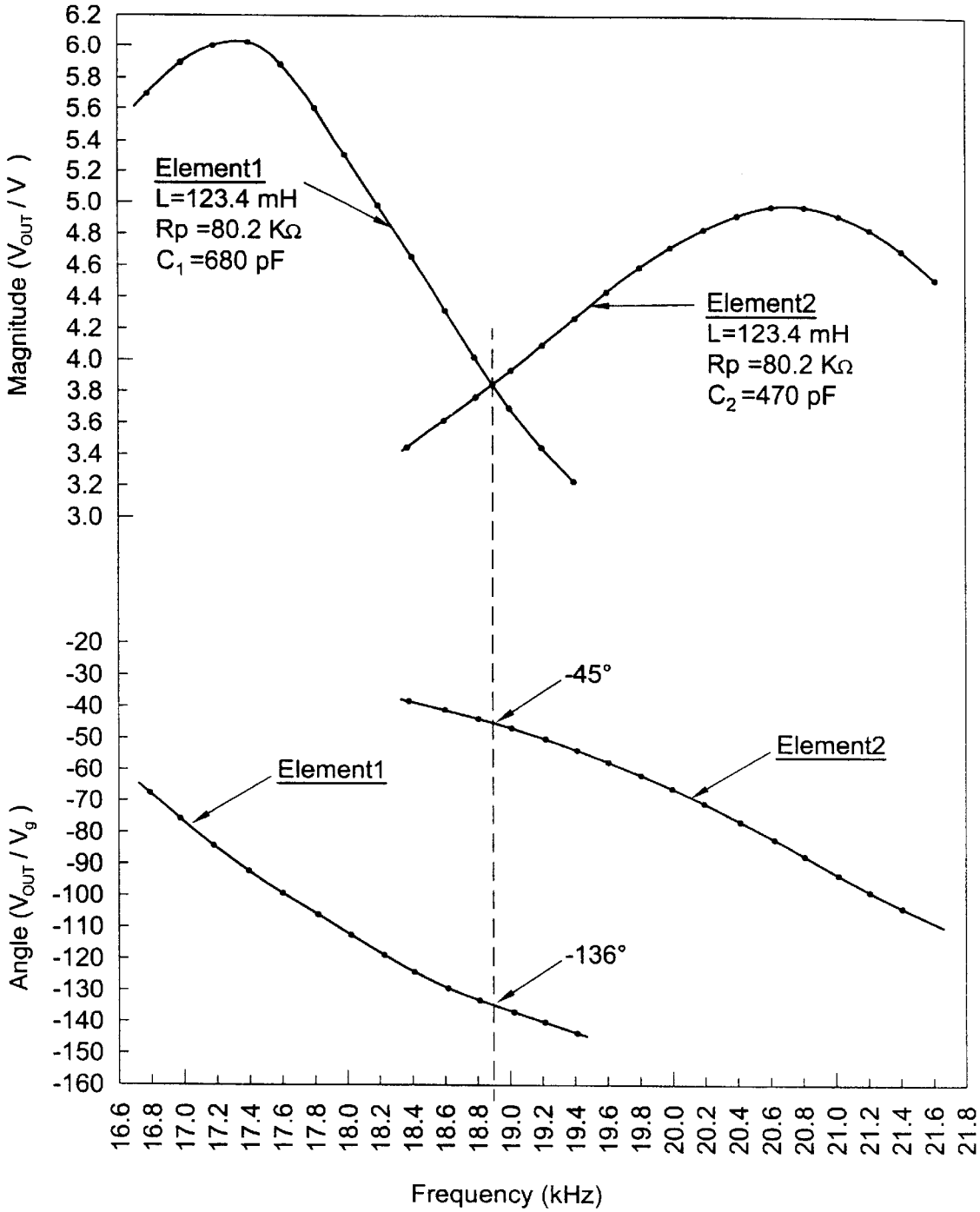
FIG. 10 is a diagram of the frequency response of magnitude and phase of individual elements comprising the two-axis, single output magnetic field sensing antenna for a particular embodiment designed for an operating frequency of 18.90 kHz.

One embodiment having $f_o$=18.9 kHz and $Q_{avg}$=5.47 is designed using standard capacitor values $C_1$=680 pF, L=123.4 mH and $R_p$=80.2 kΩ. The individual resonant frequencies turn out to be $f_{r1}$=17.38 kHz and $f_{r2}$=20.91 kHz. The theoretical amplitude and phase responses for these two elements as described by Equations 15 and 18 are plotted in FIG. 10 which shows equal per element magnitude response of 3.88 with a phase difference of 90° at 18.9 kHz. This satisfies requirements (a) and (b) for planar omnidirectional magnetic field sensing at $f_o$=18.9 kHz.

Figure 11A:
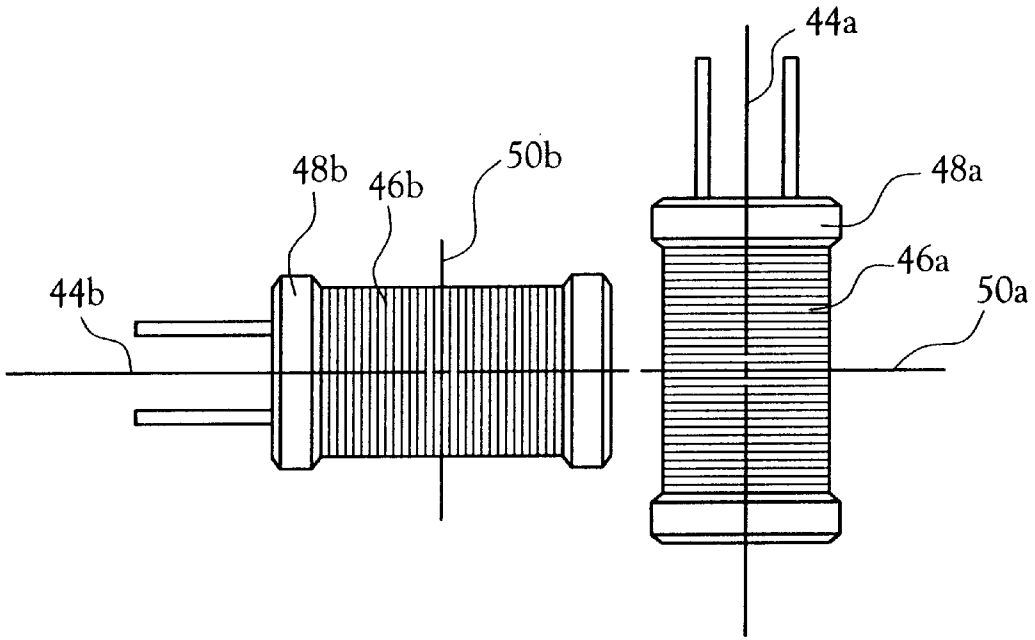
FIG. 11*a* is front elevation view of one embodiment of the inductor sensing elements comprising the two-axis, single output magnetic field sensing antenna.
Figure 11B:
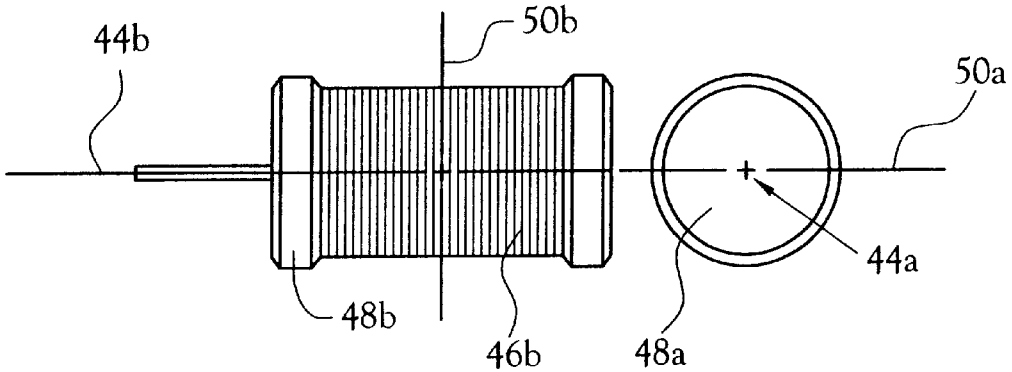
FIG. 11*b* is bottom plan view of the embodiment of the inductor sensing elements of FIG. 11*a;*

Requirements (c) and (d) for the two-axis, single output antenna 10 specify that the elements $E_1$ and $E_2$ must be positioned with the sensing axis 44 of one being spatially orthogonal to the sensing axis 44 of the other. Furthermore, the magnetic field coupling between $E_1$ and $E_2$ is to be negligible, i.e., the mutual inductance between elements $E_1$ and $E_2$ is to be negligible compared to the self inductance of each element. This requirement is met by physically separating $L_1$ and $L_2$ to reduce the coupling. With this approach, the distance between the geometrical centers of the inductors 42 must be greater than about four times the largest dimension of either inductor 42. However, when the inductors 42 must be spaced in close proximity to each other, the mounting method of collective FIG. 11 is used to eliminate the mutual inductance. FIG. 11*a* illustrates a front view of one embodiment of the two-axis, single output antenna 10 and FIG. 11*b* illustrates a bottom view of the same. Here, the $L_2$ sensing axis 44*b* is orthogonal to the $L_1$ sensing axis 44*a* and passes through the geometrical and electromagnetic center of $L_1$, i.e., the $L_2$ sensing axis 44*b* coincides (or is co-linear) with the $L_1$ transverse axis 50*a*. For illustration, both inductors 42 are depicted as solenoidal coils 46 wound on ferrite core bobbins 48.

Figure 12A:
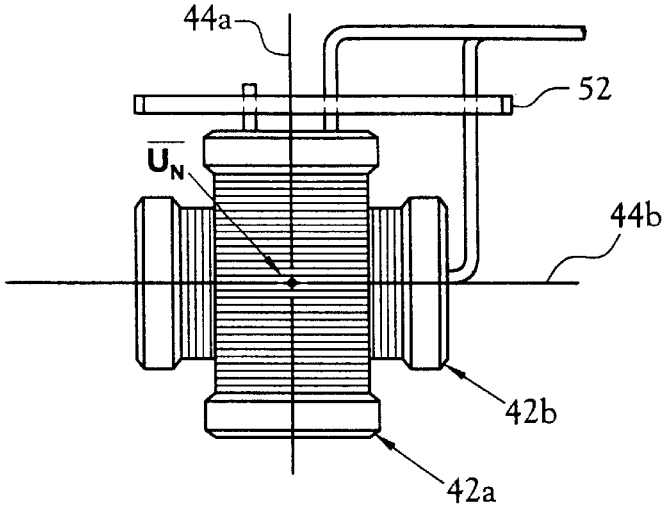
FIG. 12*a* is a front elevation view of a preferred embodiment of the individual elements comprising the two-axis, single output magnetic field sensing antenna.
Figure 12B:
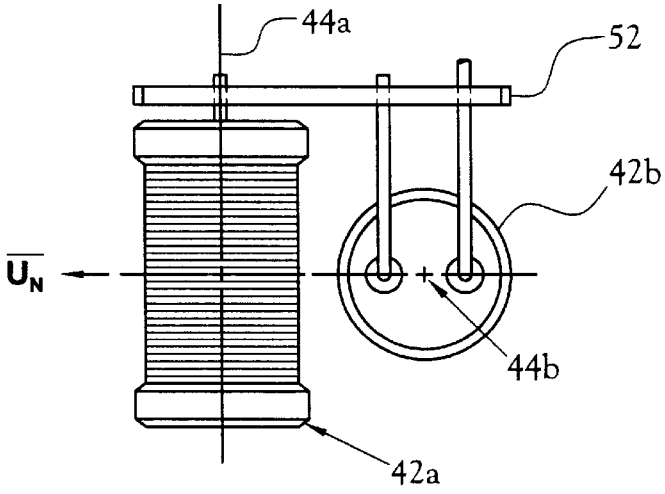
FIG. 12*b* is a right side elevation view of a preferred embodiment of the two-axis, single output antenna of FIG. 12*a;*
Figure 12C:
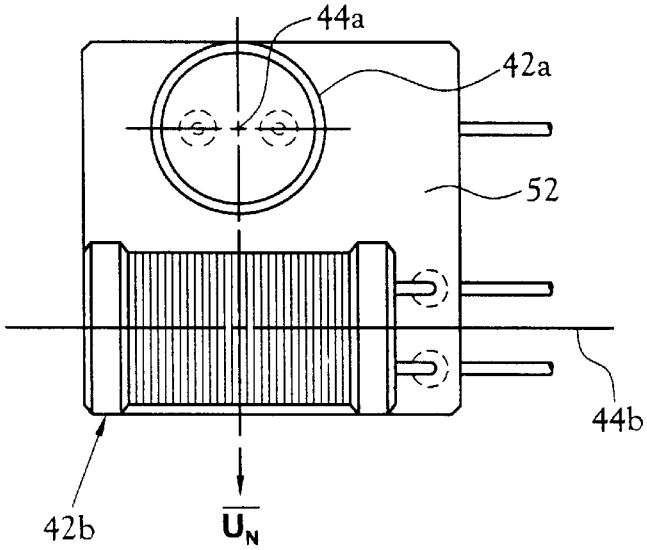
FIG. 12*c* is a bottom plan view of a preferred embodiment of the two-axis, single output antenna of FIG. 12*a;*

Although the mounting method of collective FIG. 11 theoretically eliminates the mutual inductance, the close proximity of the $L_1$ ferrite core 48*a* to $L_2$ causes a small increase in the self inductance of $L_2$. The $L_2$ core 48*b* also has a proximity effect on $L_1$, but the effect is less because the $L_2$ core 48*b* does not lie directly on the $L_1$ sensitive axis 44*a*. This unbalance in proximity effects means that the self inductances are no longer equal. This causes a mismatch in the magnetic field sensitivities of elements $E_1$ and $E_2$ which degrades the planar-omnidirectional performance. This is solved by the preferred mounting method of collective FIG. 12 wherein FIG. 12*a* illustrates a front elevation view, FIG. 12*b* illustrates a right side view, and FIG. 12*c* illustrates a bottom plan view. As required, the $L_1$ sensitive axis 44*a* is also orthogonal to the of $L_2$ sensitive axis 44*b*. In the illustrated embodiment, $L_1$ and $L_2$ are aligned so that a line passing through the geometrical and electromagnetic center of each inductor 42, the normal vector $u_N$, is orthogonal to the sensitive axes of both inductors 42, i.e., the $L_2$ transverse axis 50*b* coincides (or is co-linear) with the $L_1$ transverse axis 50*a*. This line that passes through the centers of the inductors thus becomes the normal axis of the resulting two-axis, single output antenna as indicated by the $u_N$ unit vector. Because of symmetry, the mutual inductance is theoretically eliminated and the ferrite proximity effect is the same for both elements. For the type of mounting configuration illustrated in collective FIG. 12, the proximity effect is typically a few percent. The theoretical inductance from design Equation 19 should be reduced by the proximity effect to determine the self inductance needed for $L_1$ and $L_2$ separately. The inductors $L_1$ and $L_2$, the capacitors $C_1$ and $C_2$, and the resistors $R_{p1}$ and $R_{p2}$ are conveniently mounted and interconnected via a printed circuit board 52, as illustrated in collective FIG. 12. The capacitors and resistors are preferably realized as standard surface mount components.

Design Equation 20 includes $R_p$ which accounts for the total resonant circuit losses including inductor losses, both winding and core, plus losses in any parallel resistance or loading added to control the bandwidth and Q. Losses contributed by the tuning capacitor are typically negligible for the present invention. Thus, the $R_p$ value computed from Equation 20 is really the parallel combination of the parallel-equivalent inductor losses and any added parallel resistance component.

The 18.9 kHz example design described above and having the ideal response shown in FIG. 6 is closely realized in practice using standard capacitors of 680 pF and 470 pf together with inductors of the type illustrated in FIG. 8 constructed to have separated self-inductance of 117.3 mH. The inductors are realized as about 1800 turns of AWG size 41 magnet wire wound on ferrite bobbins which are 10 mm long and 8 mm in diameter. The winding region of the bobbin is about 3.5 mm in diameter and 6 mm in length. A standard 84.5 kΩ resistor is added in parallel with each inductor to yield the desired frequency response of FIG. 6.

Figure 13A:
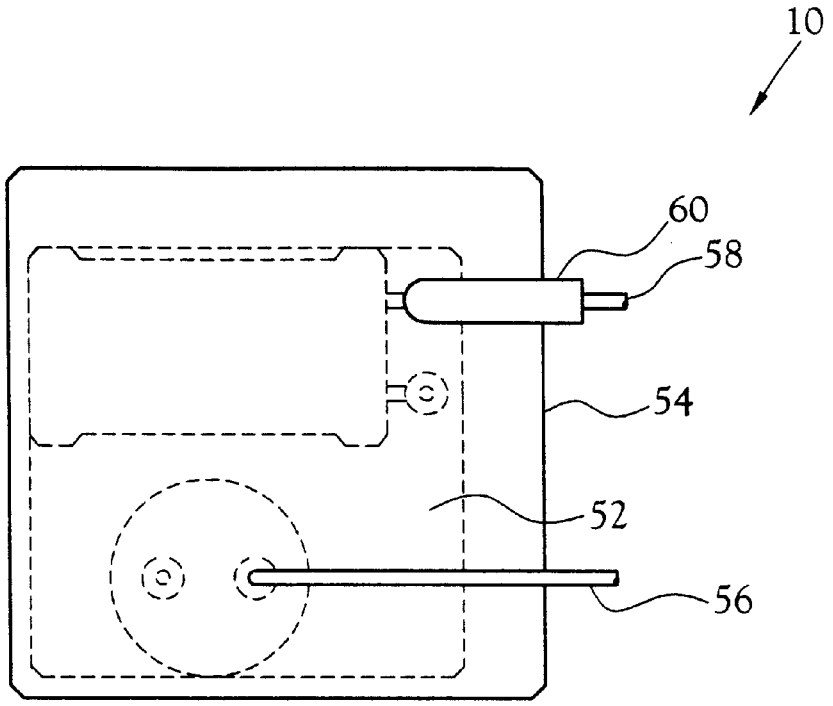
FIG. 13*a* is a top plan view of the assembled two-axis, single output magnetic field sensing antenna enclosed within a partially conducting shield for reducing the antenna's electric field sensitivity.
Figure 13B:
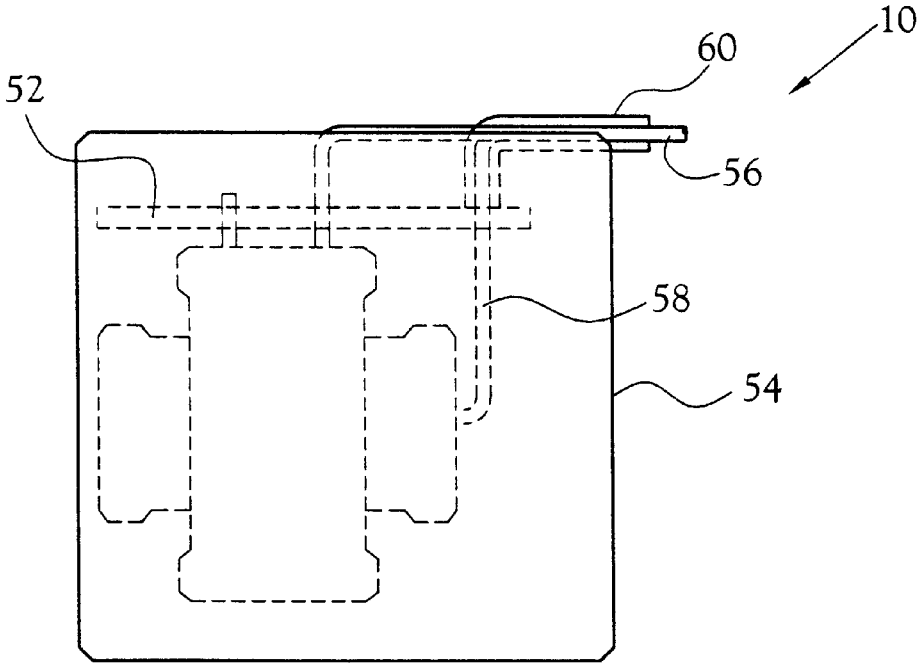
FIG. 13*b* is a front elevation view of the assembled two-axis, single output magnetic field sensing antenna of FIG. 13*a*.

Collective FIG. 13 illustrates the preferred embodiment of an optional selective shielding for the two-axis, single output antenna 10 with FIG. 13*a* representing a top plan view and FIG. 13*b* representing a front elevation view of the shielded antenna 10. The shielding is a partially conductive enclosure 54 completely surrounding the two-axis, single output antenna assembly 10. The sheet resistivity of the partially conductive enclosure 54 is chosen to selectively attenuate the incident electric field relative to the incident magnetic field. The resistivity required of the selective shield 54 is dependent on the carrier frequency of the magnetic field to be sensed and preferably should be in the range of tens of ohms per square for carrier frequencies in the commonly used frequency range of tens of kilohertz. In the preferred embodiment, the selective shield 54 completely encloses the antenna assembly 10 and is electrically isolated from all parts of the assembly 10 except for the antenna output signal conductor considered to be the low-impedance or ground side connection 56. This is conveniently accomplished by encapsulating the antenna assembly 10 in non-conductive epoxy and applying an appropriate coating to the exterior of the epoxy to realize desired selective shield 54. The high impedance conductor 58 of the $V_{out}$ signal is suitably insulated from the partially conductive coating by a non-conductive sleeve 60. Those skilled the art will recognize that the low impedance conductor 56 of the $V_{out}$ signal could be insulated from the coating in like manner and the shield coating electrically connected to the receiver unit's signal ground potential by other means. Those skilled in the art will recognize that other methods of shielding the antenna assembly 10 exist, including placing the antenna assembly 10 within a suitable housing, the outside of which is coated with the selective shield material previously described. The material used to realize the partially conductive selective shield coating is preferably one of the several graphite-based formulations commercially available as a quick-drying aerosol for spray application or as a colloidal suspension for dipping or brush application.

Figure 14:
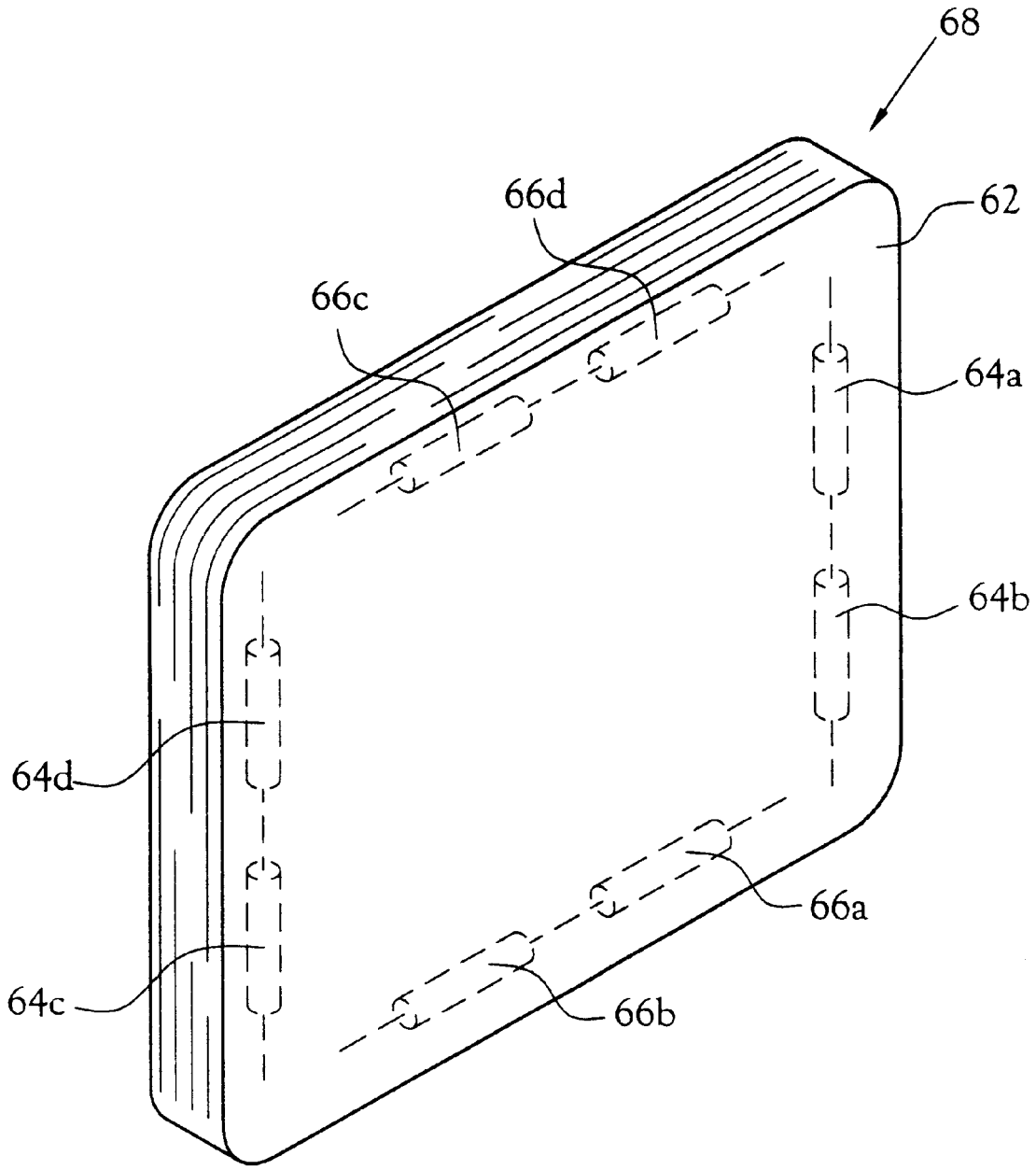
FIG. 14 is a drawing indicating means for embedding two-axis, single output magnetic field sensing antenna within a smart card.

In another example embodiment of the present invention two-axis, single output antenna 68, FIG. 14 illustrates a mutually-orthogonal distributed arrangement in which the antenna 68 is embedded in a smart card 62. The inductors are subdivided into a plurality of magnetic field sensing inductor components 64, 66 which are suitably connected in series to form the lumped element $L_1$ 64*a*–64*d* and $L_2$ 66*a*–66*d* values (the capacitors and resistors are not shown) of Equation 19. These connections are conveniently realized with a printed circuit board (not shown) which is embedded in the smart card 62. Cost and physical thickness of the smart card antenna 68 are kept low by realizing the magnetic field sensing inductor components 64 from unshielded, axial leaded, ferrite inductors as used in the epoxy conformal coated standard value inductors commonly available from electronic component vendors in values up to 1000 μH. The method of realizing the two-axis, single output antenna in a smart card configuration 68 is particularly effective for eliminating possible loss of performance when the smart card 62 is brought into close proximity with other electrically conductive objects. The smart card antenna 68 provides for application of magnetic-field-based distance determining methods known to those skilled in the art whereby the exact distance separating the smart card-bearer and a kiosk base station is determined for the purpose of allowing the kiosk to otherwise communicate only with the smart card 62 physically nearest the kiosk or only with a smart card 62 positioned in a designated restricted area in the vicinity of the kiosk location.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An antenna assembly for sensing a time-varying magnetic field having a predetermined frequency, said antenna assembly comprising:

a first element having a sensing axis producing an amplitude response to the magnetic field and a transverse axis orthogonal to said sensing axis, said first element including at least one inductor; and a second element in electrical communication with said first element, said second element having a sensing axis producing an amplitude response to the magnetic field and a transverse axis orthogonal to said sensing axis, said second element sensing axis being orthogonal to said first element sensing axis, either of said first element sensing axis and said first element transverse axis being parallel with said second element transverse axis, said second element not magnetically coupled to said first element, said second element including at least one inductor, said first element and said second element being serially connected thereby producing an antenna assembly having a single pair of output leads.

2. The antenna assembly of claim 1 wherein each said first element and said second element have common amplitude response characteristics.

3. The antenna assembly of claim 1 wherein each of said first element and said second element produce an amplitude response which is proportional to a magnetic field direction vector sensed by each of said first element and said second element.

4. The antenna assembly of claim 1 wherein each of said first element and said second element define a transduction scaling factor, said first element transduction scaling factor being equal to said second element transduction scaling factor offset by a time domain phase difference of approximately 90 degrees.

5. The antenna assembly of claim 1 wherein each of said first element and said second element include an inductor having a magnetic core with a small loss tangent at a predetermined output frequency.

6. The antenna assembly of claim 1 each of said first element and said second element having a quality factor in the range of approximately 4 to approximately 8.

7. The antenna assembly of claim 1 wherein said first element transverse axis is co-linear with said second element transverse axis.

8. The antenna assembly of claim 1 wherein said first element sensing axis is co-linear with said second element transverse axis.

9. The antenna assembly of claim 8 said first element being physically separated from said second element by a predetermined distance thereby reducing the inductive coupling therebetween.

10. The antenna assembly of claim 9 wherein one said first element and said second element define a largest dimension, said predetermined distance being greater than approximately four times said largest dimension.

11. The antenna assembly of claim 1 further comprising a shield, said shield being a partially conductive enclosure having a sheet resistivity chosen to selectively attenuate an electric field relative to the magnetic field, said shield enclosing said first element and said second element.

12. The antenna assembly of claim 11 wherein said shield sheet resistivity is in a range of approximately tens of ohms per square for a carrier frequency within a frequency range of approximately tens of kilohertz.

13. The antenna assembly of claim 11 wherein said antenna assembly includes a high-impedance lead and a low-impedance lead, said shield electrically connected to said low-impedance lead and insulated from said high-impedance lead.

14. The antenna assembly of claim 1 wherein said first element and said second element lie in different planes.

15. An antenna assembly for sensing a time-varying magnetic field having a predetermined frequency, said antenna assembly comprising:

a first element having a sensing axis producing an amplitude response to the magnetic field and a transverse axis orthogonal to said sensing axis, said first element being a parallel LCR circuit, including at least one inductor, at least one resistor, and at least one capacitor; and a second element in electrical communication with said first element, said second element having a sensing axis producing an amplitude response to the magnetic field and a transverse axis orthogonal to said sensing axis, said second element sensing axis being orthogonal to said first element sensing axis, either of said first element sensing axis and said first element transverse axis being parallel with said second element transverse axis, said second element being a parallel LCR circuit, including at least one inductor, at least one resistor, and at least one capacitor, said first element and said second element being serially connected thereby producing an antenna assembly having a single pair of output leads.

16. The antenna assembly of claim 15 wherein each of said first element at least one inductor and said second element at least one inductor have equivalent inductance.

17. An antenna assembly for sensing a time-varying magnetic field having a predetermined frequency, said antenna assembly comprising:

an enclosure;

a first element having a sensing axis producing an amplitude response to the magnetic field and a transverse axis orthogonal to said sensing axis, said first element including a plurality of inductors serially connected and disposed along two opposing edges of said enclosure, each of said first element plurality of inductors being oriented parallel to each other; and a second element in electrical communication with said first element, said second element having a sensing axis producing an amplitude response to the magnetic field and a transverse axis orthogonal to said sensing axis, said second element sensing axis being orthogonal to said first element sensing axis, either of said first element sensing axis and said first element transverse axis being parallel with said second element transverse axis, said second element including a plurality of inductors serially connected and disposed along two opposing edges of said enclosure, each of said second element plurality of inductors being oriented parallel to each other and orthogonal to each of said first element plurality of inductors, said first element and said second element being serially connected thereby producing an antenna assembly having a single pair of output leads.

18. An antenna assembly for sensing a time-varying magnetic field having a signal frequency, said antenna assembly comprising:

a first element including a first magnetic core member and a first coil wound around said first magnetic core member, said first coil having a first end and a second end, said first element forming an inductance-resistance-capacitance resonant circuit having a resonant frequency;

a second element including a second magnetic core member and a second coil wound around said second magnetic core member, said second coil having a first end and a second end, said second element disposed substantially perpendicular to said first element, said second element not magnetically coupled to said first element, said second coil first end in communication with said first coil second end, said second element forming an inductance-resistance-capacitance resonant circuit having a resonant frequency; and an output defined by said first coil first end and said second coil second end.

19. The antenna assembly of claim 18 wherein said first element resonant frequency is different from said second element resonant frequency.

20. The antenna assembly of claim 18 wherein said first element resonant frequency is a frequency below the time-varying magnetic field signal frequency and said second element resonant frequency is a frequency above the time-varying magnetic field signal frequency.

21. The antenna assembly of claim 20 wherein the magnetic field produces a time domain phase response in each of said first element and said second element, said first element time domain phase response being offset from said second element time domain phase response by an odd integer multiple of approximately 90 degrees.

22. The antenna assembly of claim 18 wherein said first element and second element are not coplanar.

23. An antenna assembly for producing a two-dimensional response to a time-varying magnetic field at a single output, said antenna assembly comprising:

a first element producing an amplitude response to the magnetic field, said first element having a longitudinal axis defining a sensing axis, said first element having a resonant frequency; and a second element producing an amplitude response to the magnetic field, said second element having a longitudinal axis defining a sensing axis, said second element sensing axis being orthogonal to said first element sensing axis, said second element sensing axis not intersecting with said first element, said second element being in serial electrical communication with said first element, said second element having a resonant frequency, wherein the magnetic field produces a time domain phase response in each of said first element and said second element, said first element time domain phase response being offset from said second element time domain phase response by an odd integer multiple of approximately 90 degrees.

24. The antenna assembly of claim 23 wherein the magnetic field has a signal frequency, said first element resonant frequency being greater than the signal frequency and said second element resonant frequency being less than the signal frequency.

25. The antenna assembly of claim 23 wherein said first element sensing axis bisects said second element.

26. The antenna assembly of claim 23 wherein said first element sensing axis does not intersect with said second element and a projection of said first element sensing axis bisects a projection of said second element sensing axis upon a common plane.

27. An antenna assembly for sensing a time-varying magnetic field having a signal frequency, said antenna assembly comprising:

a first element including a first magnetic core member and a first coil wound around said first magnetic core member, said first coil having a first end and a second end, said first element having a resonant frequency;

a second element having a resonant frequency and including a second magnetic core member and a second coil wound around said second magnetic core member, said second coil having a first end and a second end, said second element disposed substantially perpendicular to said first element, said second coil first end in communication with said first coil second end, wherein the magnetic field produces a time domain phase response in each of said first element and said second element, said first element time domain phase response being offset from said second element time domain phase response by an odd integer multiple of approximately 90 degrees; and an output defined by said first coil first end and said second coil second end.

28. The antenna assembly of claim 27 wherein the magnetic field has a signal frequency, said first element resonant frequency being greater than the signal frequency and said second element resonant frequency being less than the signal frequency.

* * * * *